US010266315B2

(12) United States Patent
Kieras et al.

(10) Patent No.: US 10,266,315 B2
(45) Date of Patent: Apr. 23, 2019

(54) UPRIGHT DISPENSER

(71) Applicant: David S. Smith America, Inc., Lester Prairie, MN (US)

(72) Inventors: Ronald E. Kieras, Bolingbrook, IL (US); Loren L. Brelje, Glencoe, MN (US)

(73) Assignee: David S. Smith America, Inc., Lester Prairie, MN (US)

( * ) Notice: Subject to any disclaimer, the term of this patent is extended or adjusted under 35 U.S.C. 154(b) by 0 days.

(21) Appl. No.: 15/861,157

(22) Filed: Jan. 3, 2018

(65) Prior Publication Data

US 2018/0186522 A1 Jul. 5, 2018

Related U.S. Application Data

(60) Provisional application No. 62/442,146, filed on Jan. 4, 2017.

(51) Int. Cl.
*B65D 47/06* (2006.01)
*B65D 47/32* (2006.01)
*B65D 47/24* (2006.01)

(52) U.S. Cl.
CPC ..... *B65D 47/32* (2013.01); *B65D 47/06* (2013.01); *B65D 47/248* (2013.01); *B65D 2205/02* (2013.01)

(58) Field of Classification Search
CPC .... B65D 47/32; B65D 47/06; B65D 2205/02; B65D 47/248
See application file for complete search history.

(56) References Cited

U.S. PATENT DOCUMENTS 4,471,807 A * 9/1984 Lucking ..... B67D 3/043 137/614.12
4,475,566 A * 10/1984 Haines ..... B67B 7/26 137/318
5,337,775 A * 8/1994 Lane ..... B65D 77/067 137/318
6,401,752 B1 * 6/2002 Blackbourn ..... B67D 3/044 137/588
8,402,999 B2 * 3/2013 Nini ..... B67D 3/044 137/588
8,459,510 B2 * 6/2013 Richards ..... B65D 47/249 222/188

(Continued)

*Primary Examiner* — Frederick C Nicolas
(74) *Attorney, Agent, or Firm* — Vidas Arrett & Steinkraus P.A.

(57) ABSTRACT

The inventive provides an upright dispenser which has an attachment end for attaching the dispenser to a container for holding material to be dispensed, the attachment end having a passageway which communicates with the container, a dispensing tub having upper and lower through holes which connect to the attachment end passageway, the upper through holes providing a vent and the lower through hole providing a path for the material to be dispensed. The attachment end passageway has a sealing flange positioned below the upper and lower through holes in the dispensing tube. The attachment end has a top end with an elastic button, the elastic button being connected to a valve stem, the valve stem extending in the passageway and having a valve end which sealing engages with the sealing flange when the elastic button is in an undepressed position.

14 Claims, 22 Drawing Sheets

(56) References Cited

U.S. PATENT DOCUMENTS

| | | | | |
|---|---|---|---|---|
| 8,464,917 | B2 * | 6/2013 | Nini | B67D 3/0045 222/481.5 |
| 8,690,026 | B2 * | 4/2014 | Richards | B65D 47/32 222/484 |
| 9,448,095 | B2 * | 9/2016 | Maher | B65D 11/22 |
| 2018/0188092 | A1 * | 7/2018 | Kieras | G01F 11/32 |

* cited by examiner

UPRIGHT DISPENSER

CROSS-REFERENCE TO RELATED APPLICATIONS

This application claims priority to provisional application No. 62/442,146, filed Jan. 4, 2017, the entire contents of which is hereby incorporated by reference.

STATEMENT REGARDING FEDERALLY SPONSORED RESEARCH

Not Applicable

FIELD OF THE INVENTION

The invention relates to an upright dispenser with a top elastic button, which can be attached to a container, bottle, pouch, bag or any other type of dispenser.

BACKGROUND OF THE INVENTION

Prior art dispensers dispense material unevenly because they lack a vent feature. This causes the material to flow unevenly (glugging). What is needed is an upright dispenser which has a vent feature which eliminates glugging.

BRIEF SUMMARY OF THE INVENTION

The inventive upright dispenser has an attachment end for attaching the dispenser to a container for holding material to be dispensed, the attachment end having a passageway which communicates with the container. The upright dispenser also has a dispensing tube, the dispensing tube having upper and lower through holes which connect to the attachment end passageway, the upper through holes providing a vent and the lower through hole providing a path for the material to be dispensed. The attachment end passageway has a sealing flange positioned below the upper and lower through holes in the dispensing tube. The attachment end has a top end with an elastic button, the elastic button being connected to a valve stem, the valve stem extending in the passageway and having a valve end which sealing engages with the sealing flange when the elastic button is in an undepressed position. When the elastic button is depressed, the valve end moves downwardly in the passageway to allow material to flow out of the container and through the lower through hole of the dispensing tube, when the container and upright dispenser are tipped sufficiently to allow gravity to cause the material to flow between the valve end and the sealing flange and out through the lower through hole of the dispensing tube, the upper through hole providing venting to eliminate glugging, and when the elastic button is released, it elastically returns to an undepressed position, pulling the valve end into sealing engagement with the sealing flange.

DETAILED DESCRIPTION OF THE INVENTION

Figure 1:
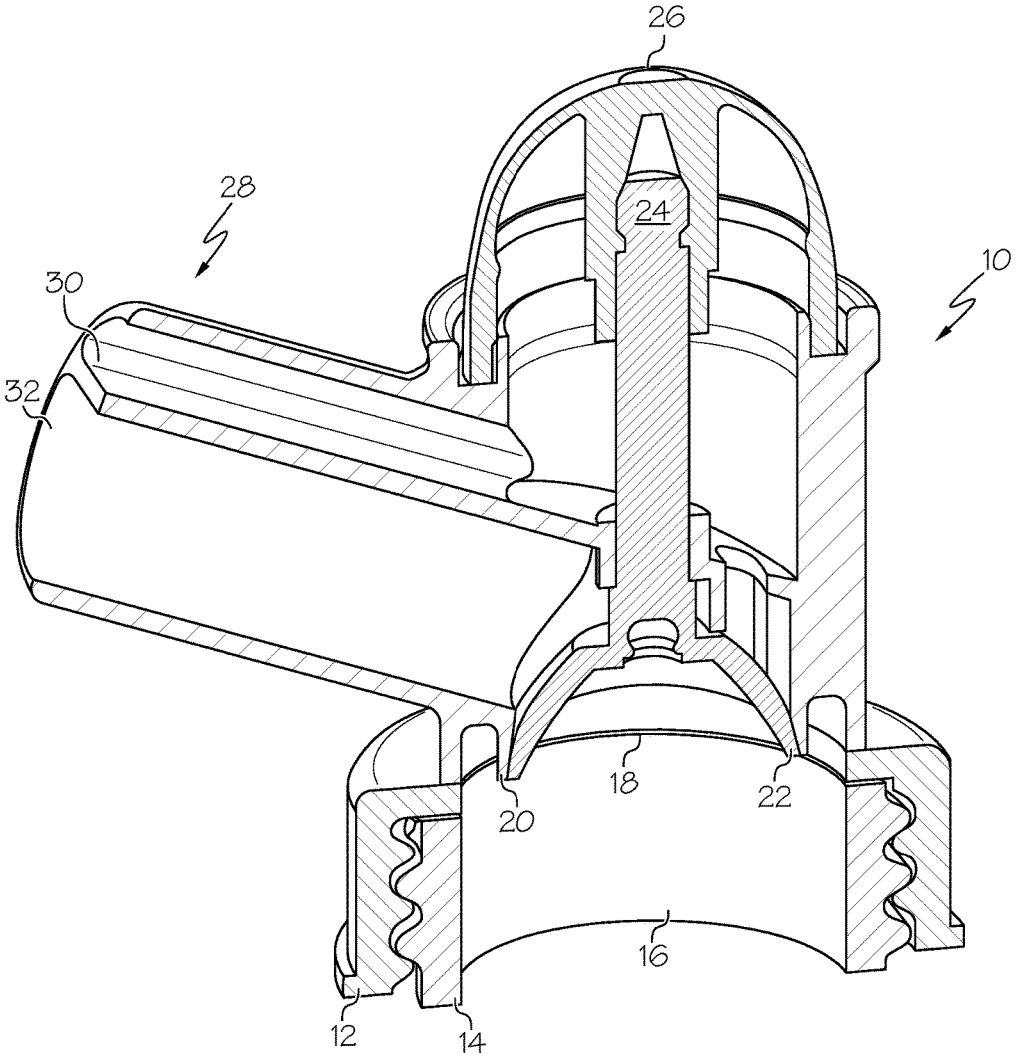
FIG. 1 is a view showing a first embodiment of an upright dispenser.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Referring now to FIG. 1, a first embodiment of the inventive upright dispenser is shown generally at 10. The attachment end is shown at 12, which threadably engages with a container 14. The container has an opening 16 which is in fluid communication with an opening in the attachment end, shown at 18. A sealing flange is shown at 20 which sealingly engages with valve end 22. The valve has a valve stem 24 which is connected to an elastic button 26. A dispensing tube is shown generally at 28, and is divided into an upper section 30 and a lower section 32. Upper section 30 provides venting, providing a path for air to communicate with the container when the valve end 22 is opened, while the lower section 32 provides a path for the fluid to be dispensed to flow when the container and dispenser are tipped sufficiently to allow gravity to cause the fluid to pour.

Figure 2:
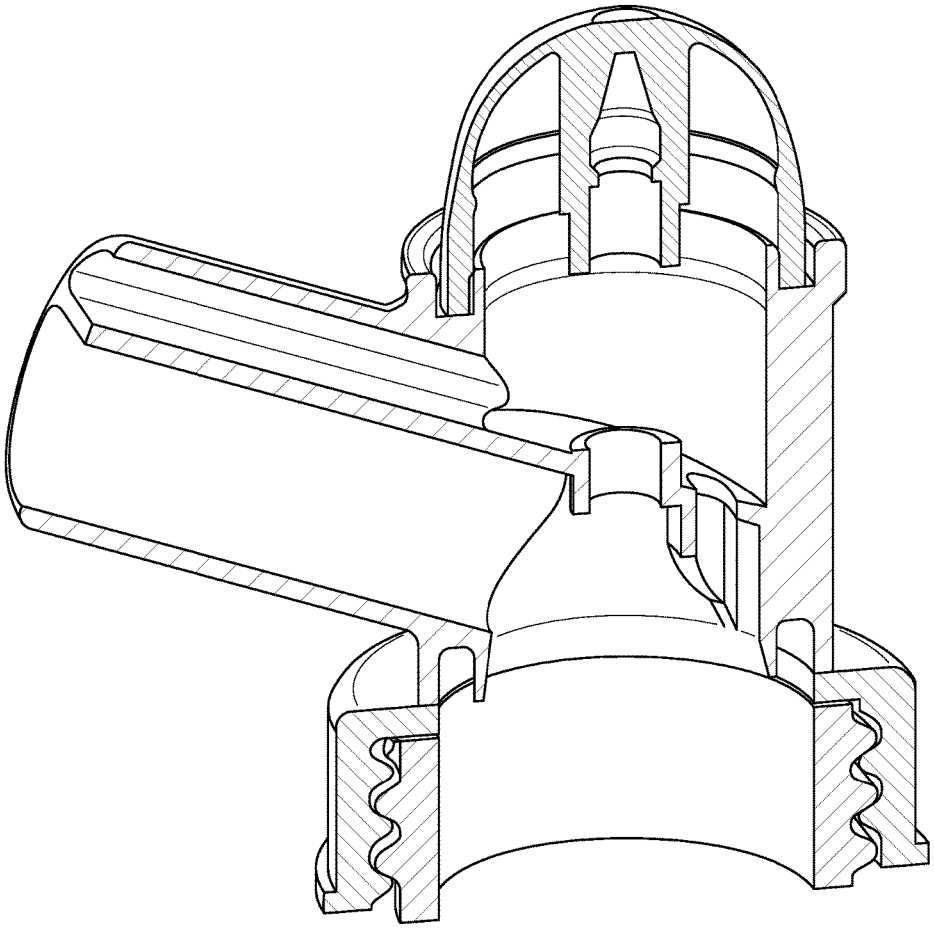
FIG. 2 is a cross section view of FIG. 1.

Referring now to FIG. 2, a cross section view of FIG. 1 is provided.

Figure 3B:
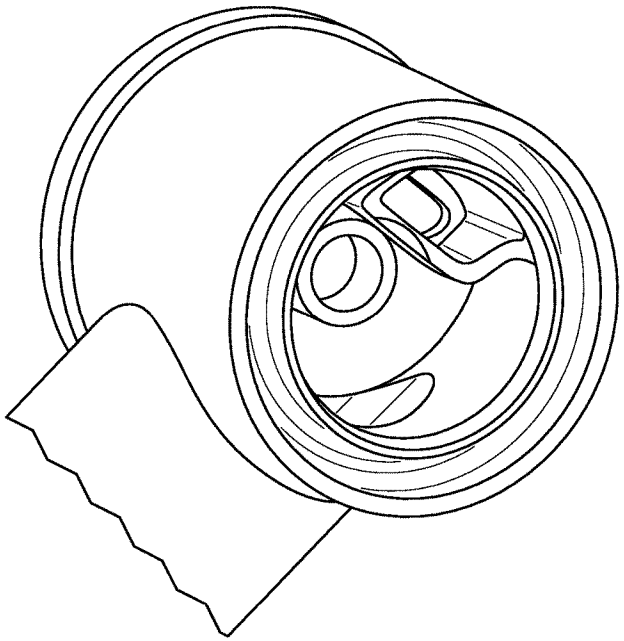
FIG. 3A and 3B are a top view of the upright dispenser of FIG. 1.
Figure 3A:
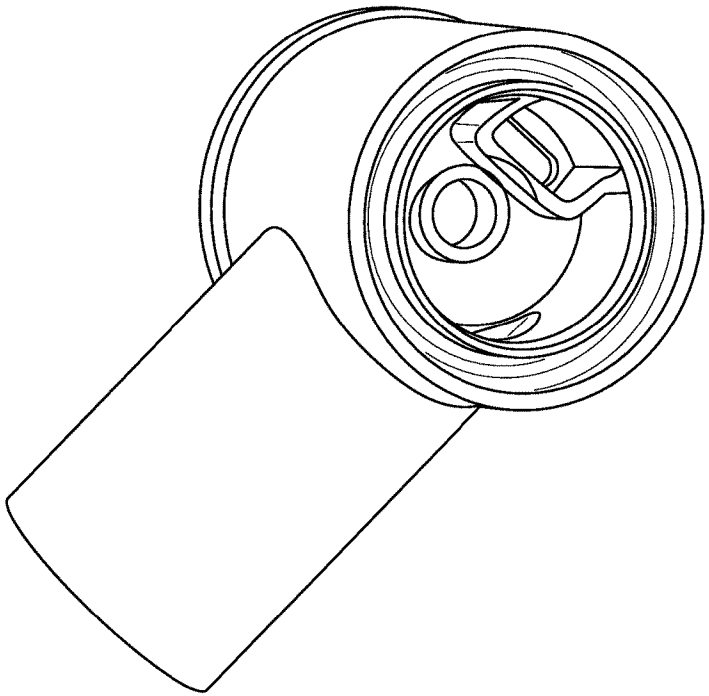

Referring now to FIG. 3A and 3B, a top view of the upright dispenser of FIG. 1 is provided.

Figure 4A:
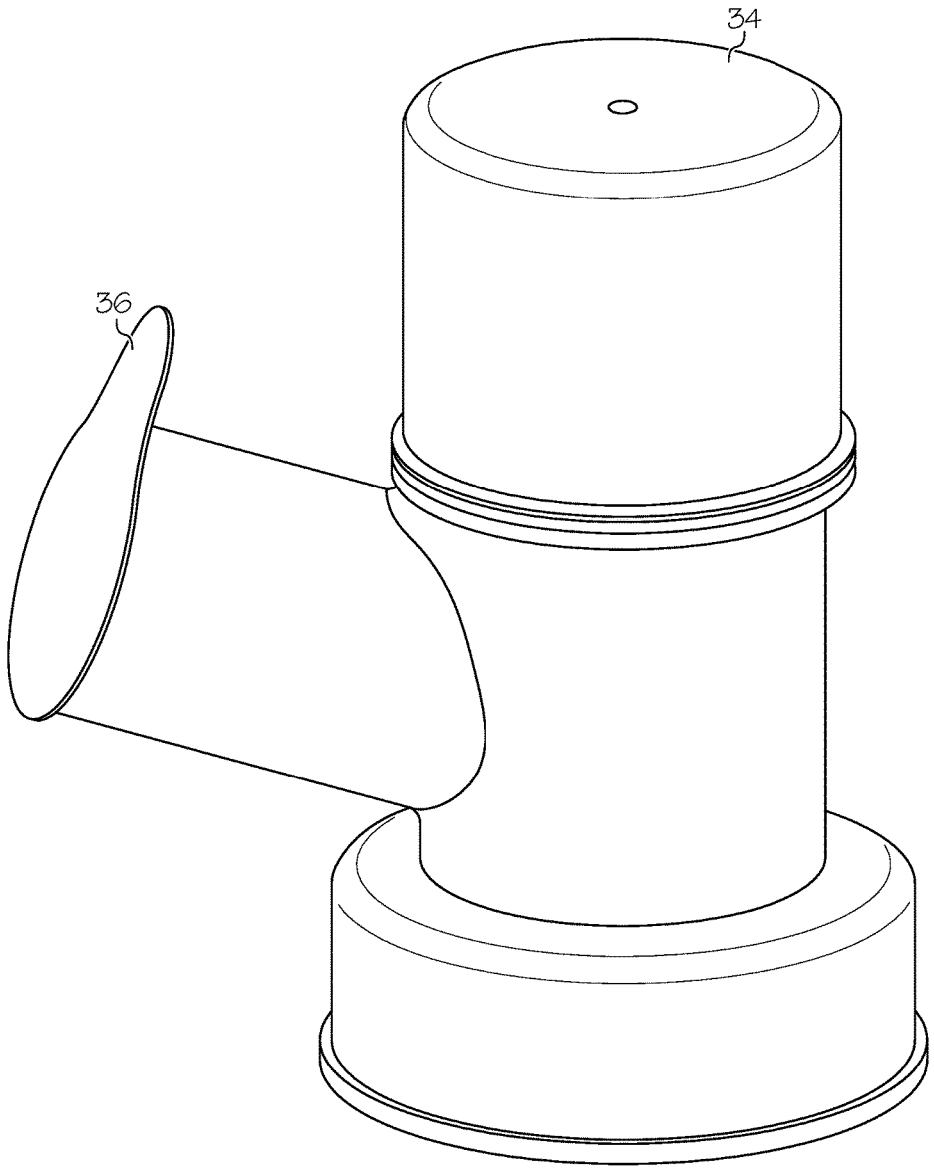
FIG. 4A shows the tamper cap, dispense foil seal and bottle foil seal and 4B show a cross-sectional view.
Figure 4B:
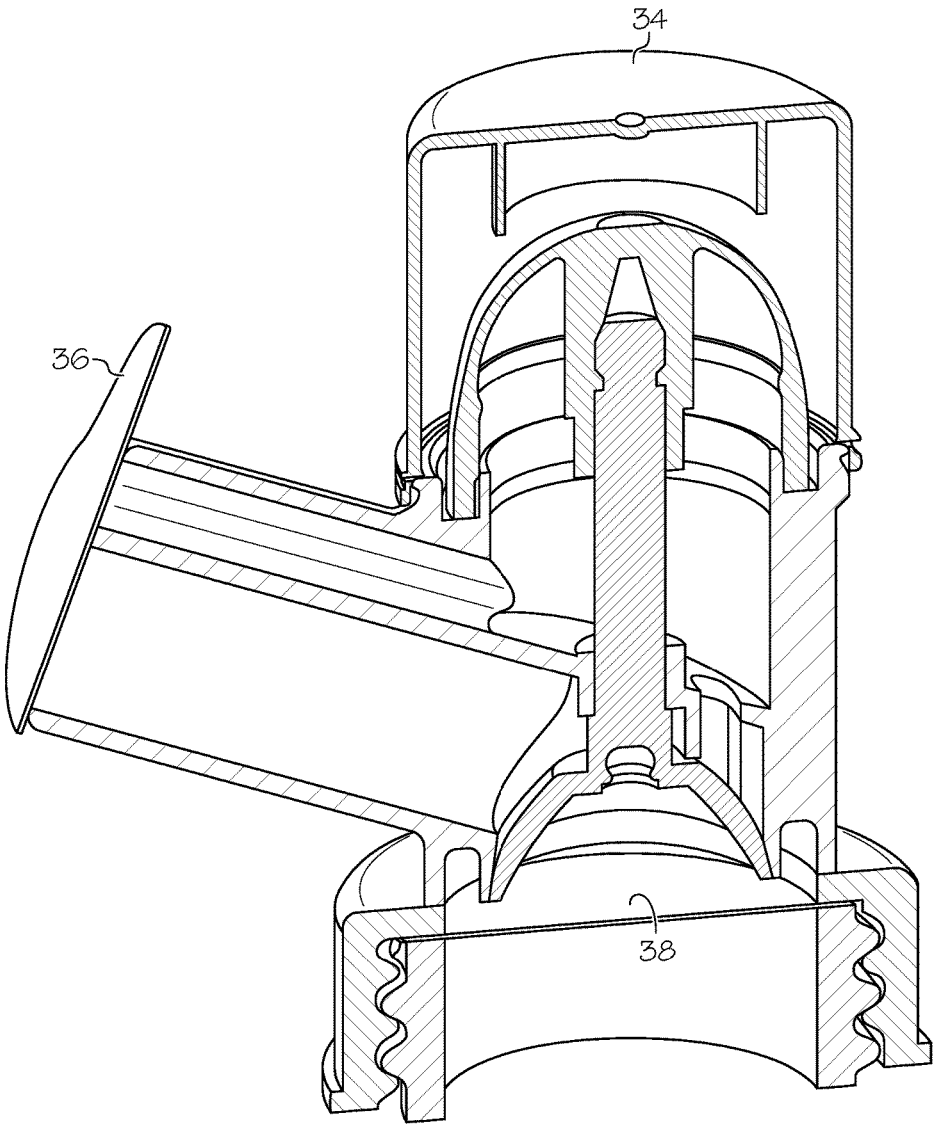

Referring now to FIG. 4A and 4B, the upright dispenser can be provided with a tamper cap, shown at 34. Tamper cap 34 can be constructed and arranged to snap fit to the upright dispenser, to cover the elastic button 26. The upright dispenser can also be provided with a dispense foil seal which covers the end of the dispensing tube 28, shown at 36. Finally, the upright dispenser can be provided with a bottle seal, shown at 38.

Figure 5A:
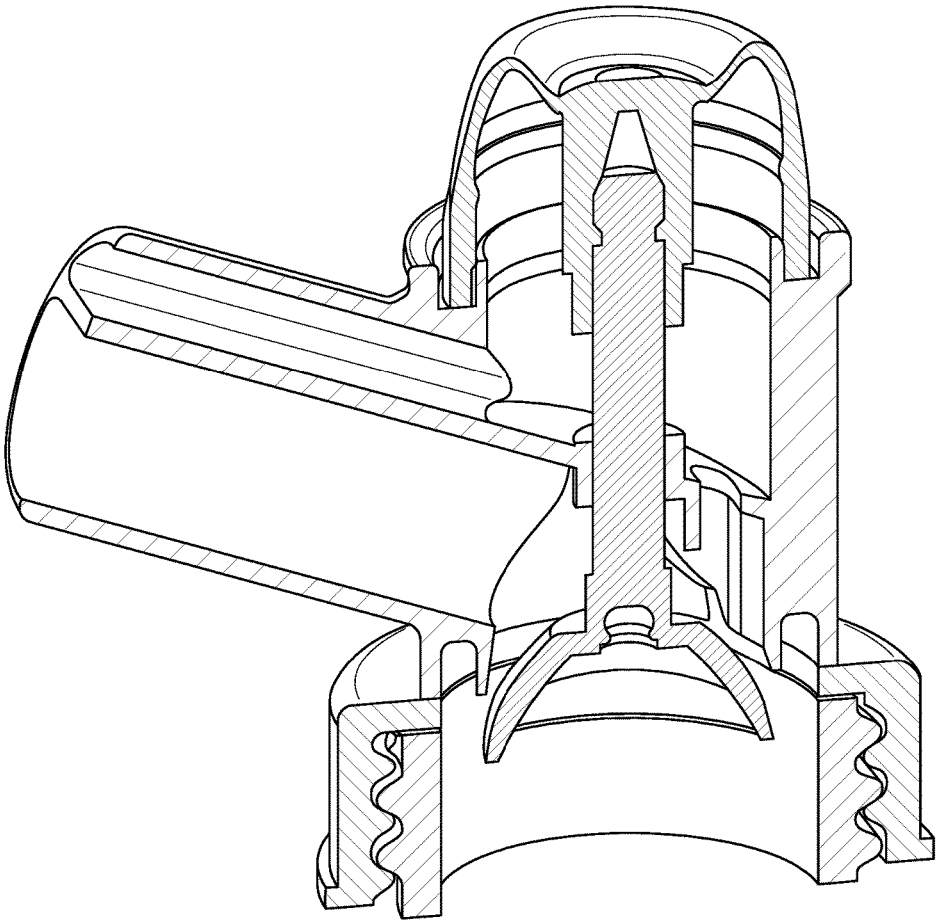
FIG. 5A and 5B are views showing the elastic button half and fully depressed.
Figure 5B:
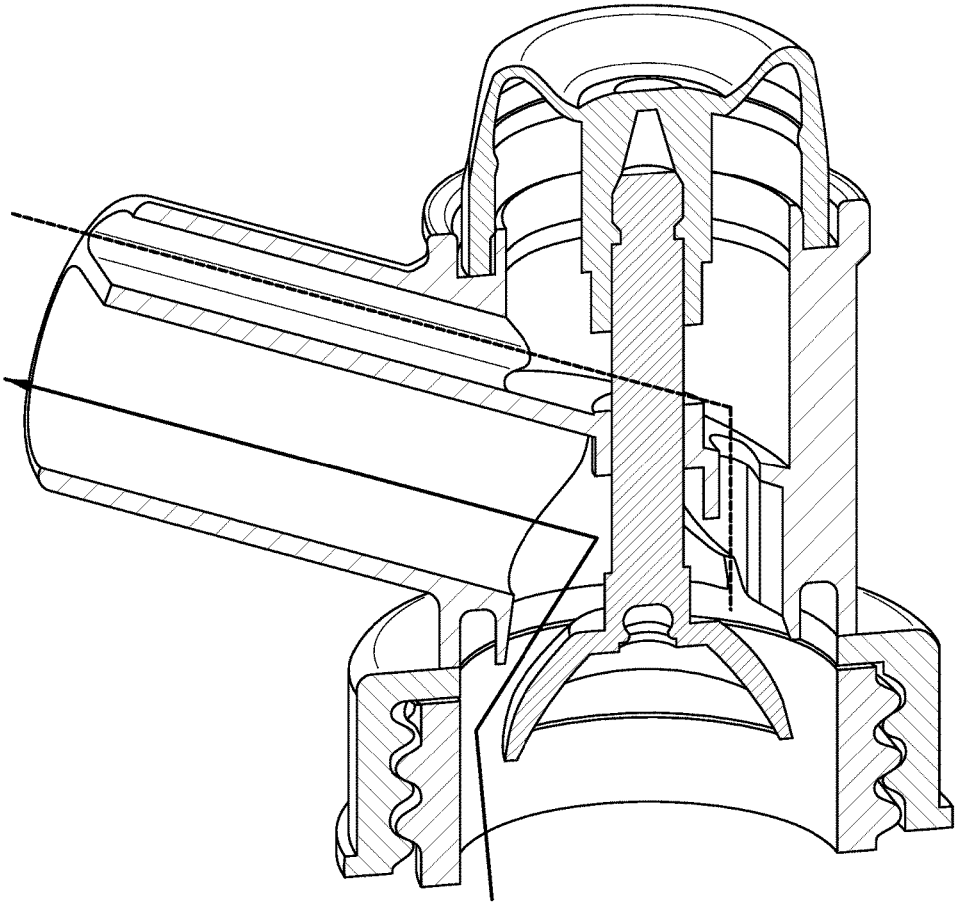

Referring now to FIG. 5A and 5B, the upright dispenser is shown with the elastic button 26 half depressed and full depressed. When the elastic button is fully depressed (i.e. open position) the air return path provided by the upper section 30 of tube 28 is shown by the red arrow. The fluid path through lower section 32 is shown with a blue arrow.

Figure 6A:
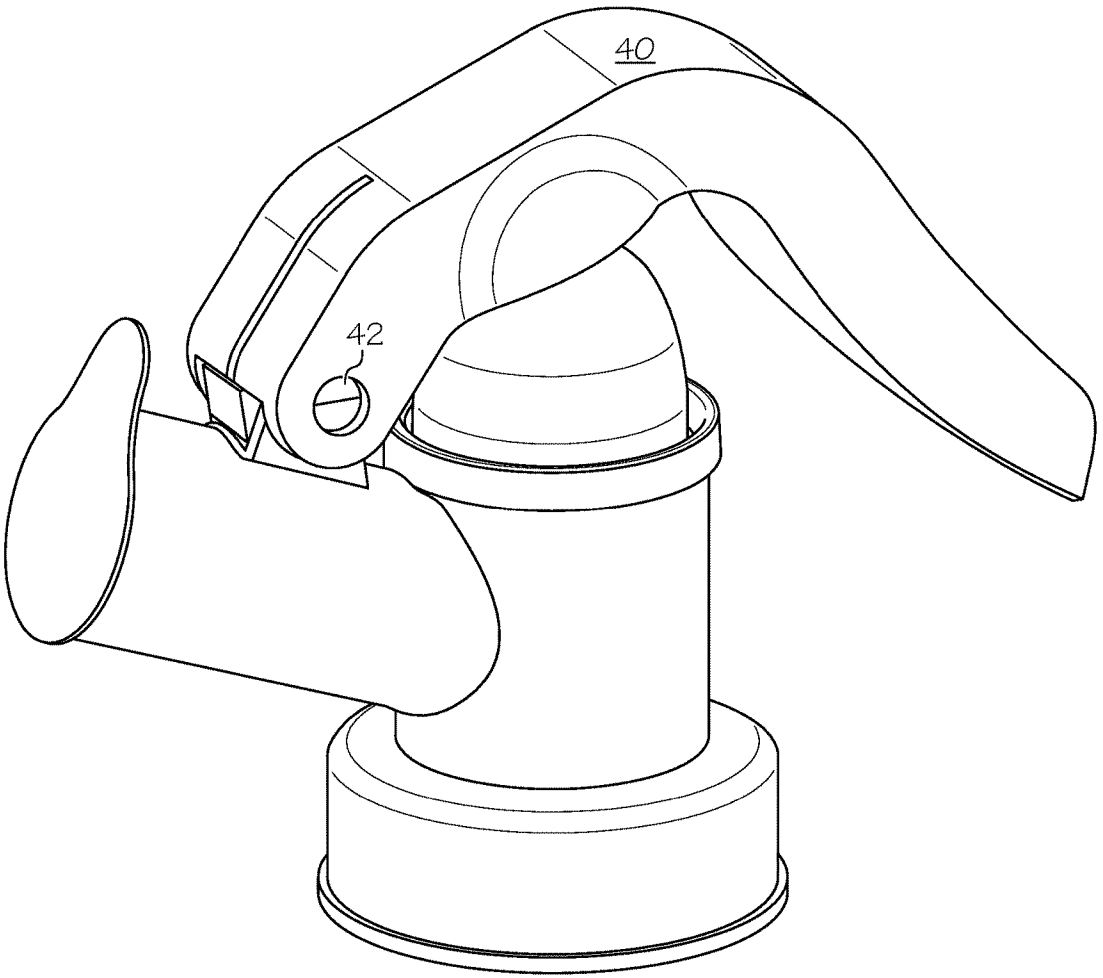
FIG. 6A is a view showing a second embodiment of an upright dispenser, including a lever arm, while 6B show a cross-sectional view.
Figure 6B:
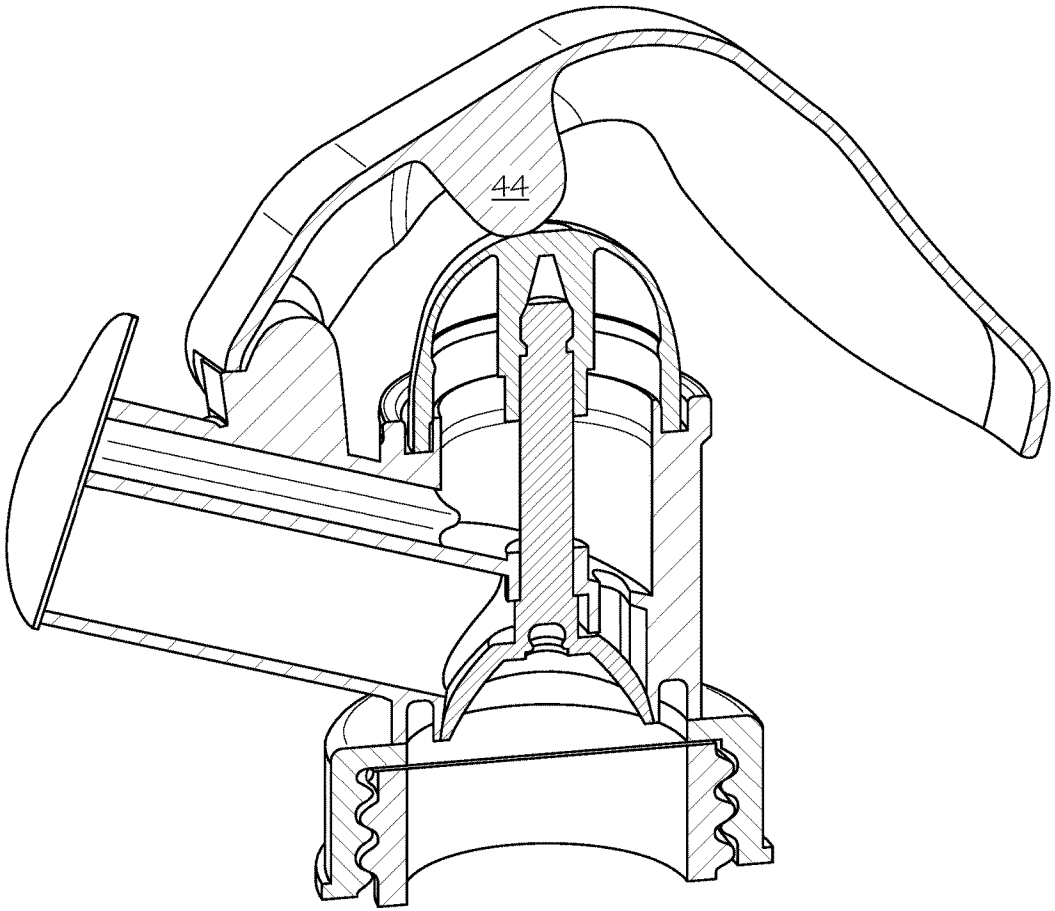

Referring now to FIG. 6A and 6B, another embodiment of the upright dispenser is shown which includes a lever arm 40, which is pivotally connected to the extension tube 28 at 42. The lever arm is shown in the normally closed position, with the elastic button 26 in the undepressed position.

Figure 7A:
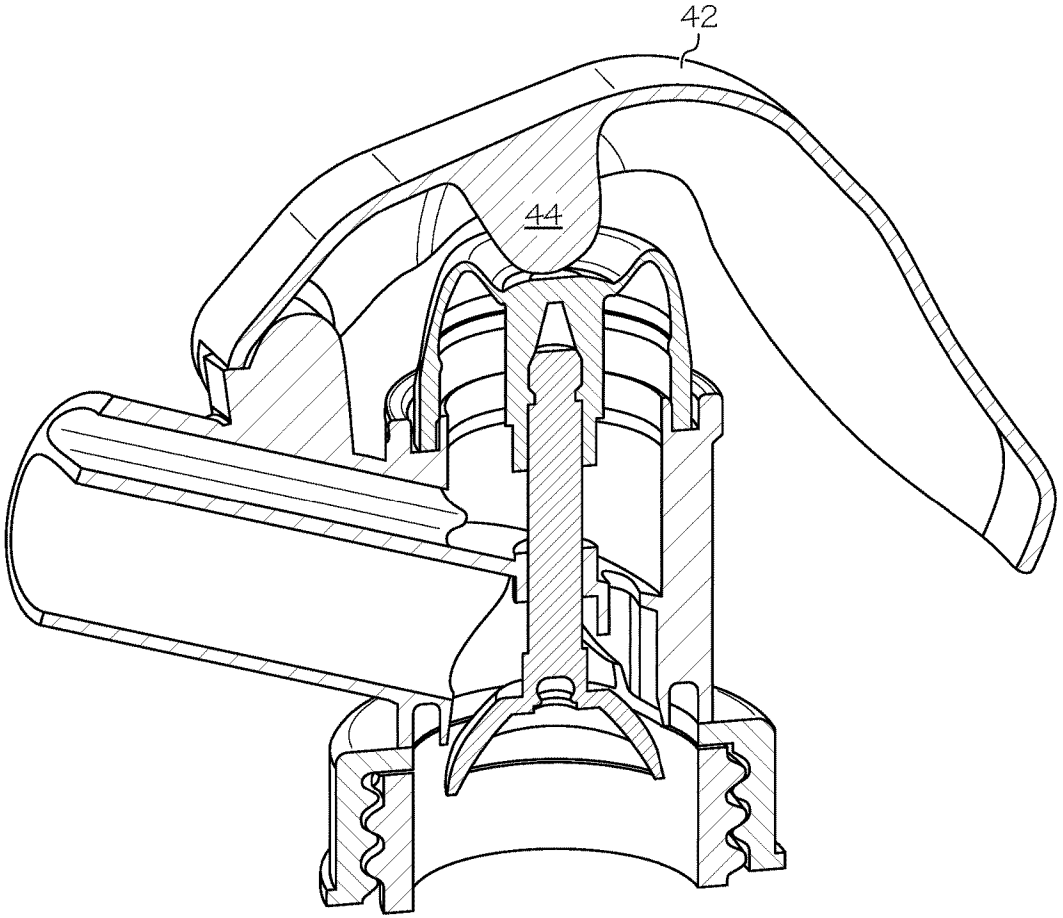
FIG. 7A and 7B shows the lever arm half open and fully open (elastic button fully depressed).
Figure 7B:
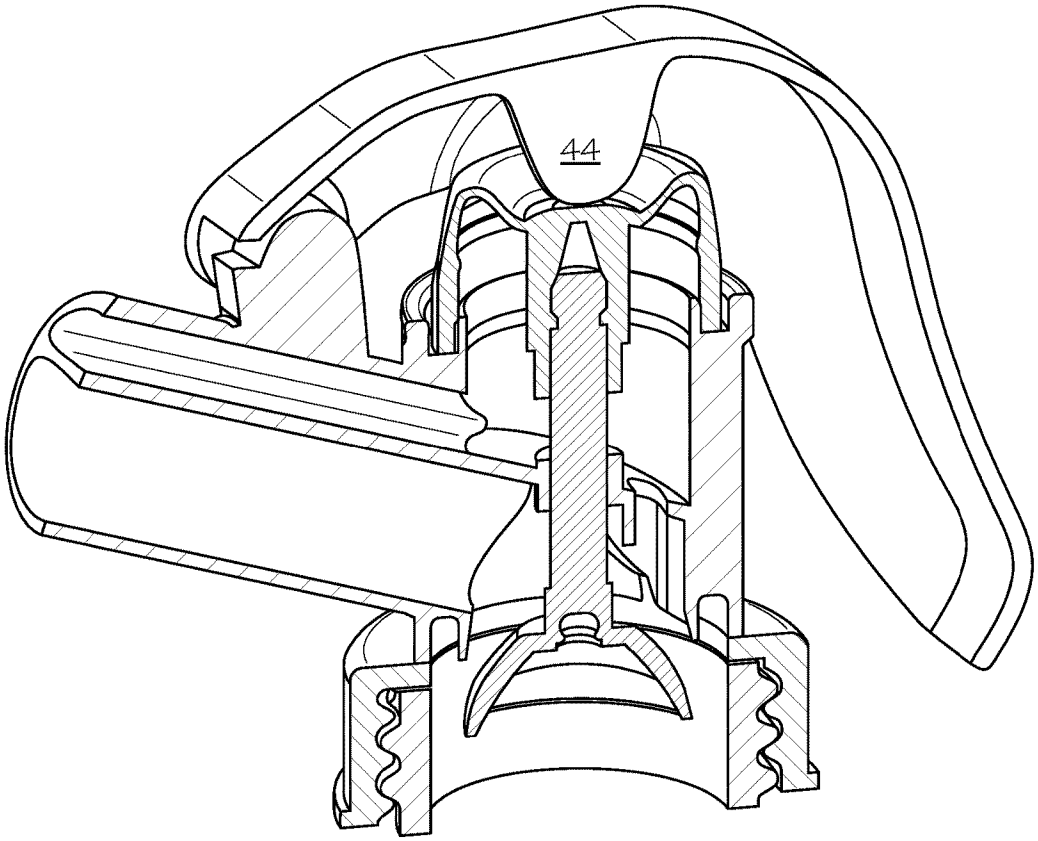

Referring now to FIG. 7A and 7B, the lever arm 42 is shown half open (the elastic button is half depressed). The elastic button is depressed by the lever arm protrusion 44. The elastic button is shown fully depressed in FIG. 7, right side figure.

Figure 8A:
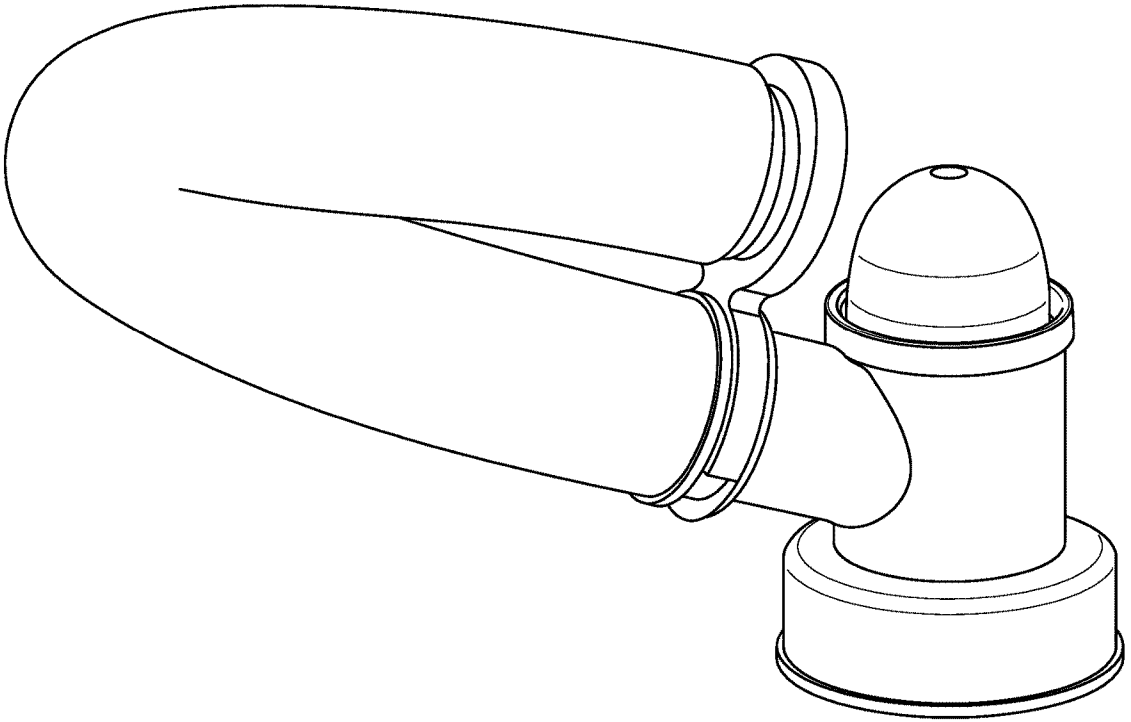
FIG. 8A and 8B is a view showing a third embodiment of an upright dispenser, including a flexible extension tube, in the open and closed positions.
Figure 8B:
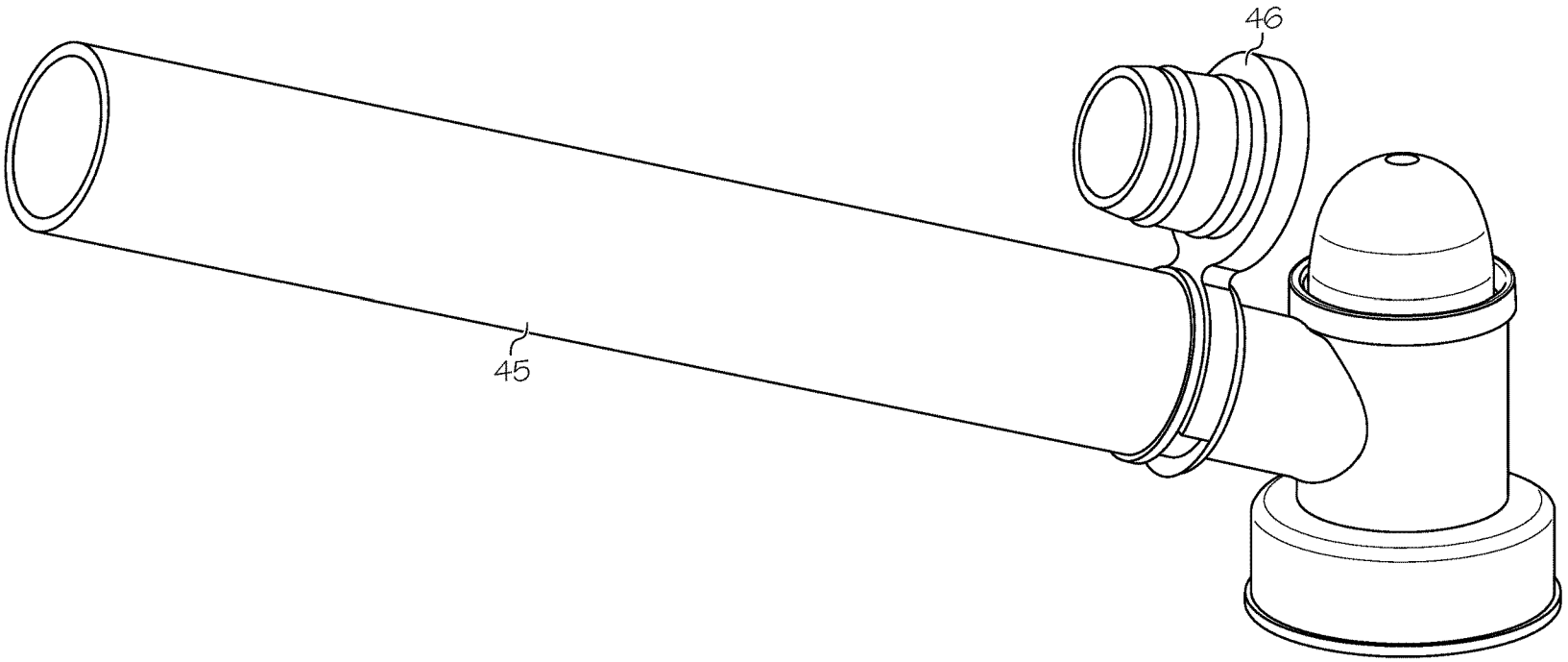

Referring now to FIG. 8A and 8B, another embodiment of the upright dispenser is shown, which includes an flexible extension tube 45 for reaching hard to reach locations. The extension tube is shown in the open (right figure) and closed position (left figure). The extension tube includes a tube plug 46, which the end of the extension tube can plug into to store the extension tube when not in use (left figure).

Figure 9:
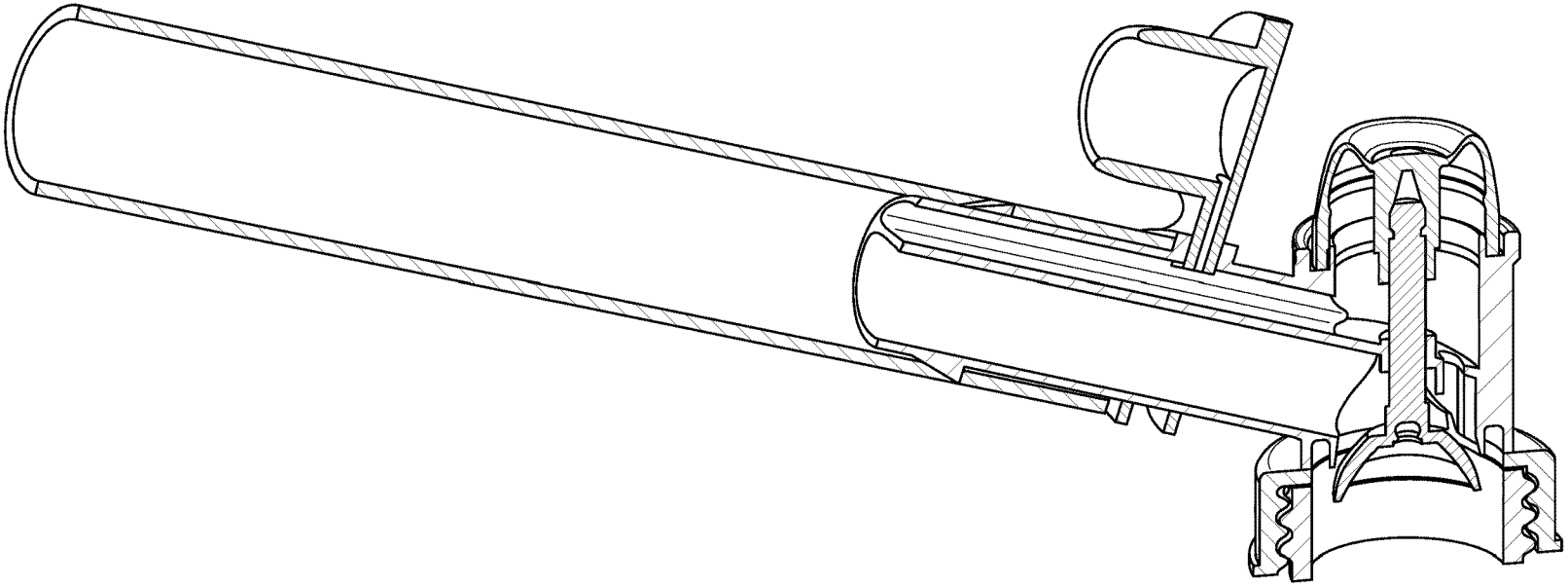
FIG. 9 shows a cross section view of FIG. 8.

Referring now to FIG. 9, the extension tube frictionally engages with dispensing tube 28. In this figure, the elastic button is half depressed, partially opening the dispenser.

Figure 10:
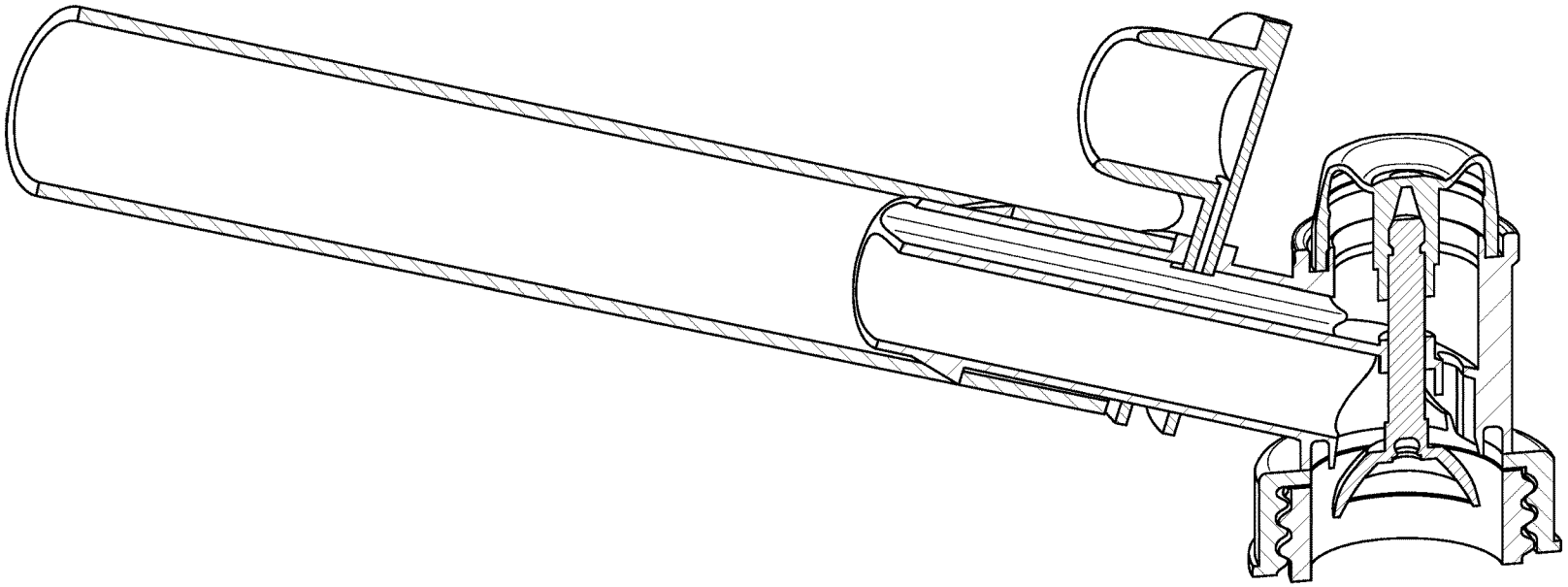
FIG. 10 shows the open position of FIG. 8.

Referring now to FIG. 10, the elastic button is shown fully depressed (open position).

Figure 11A:
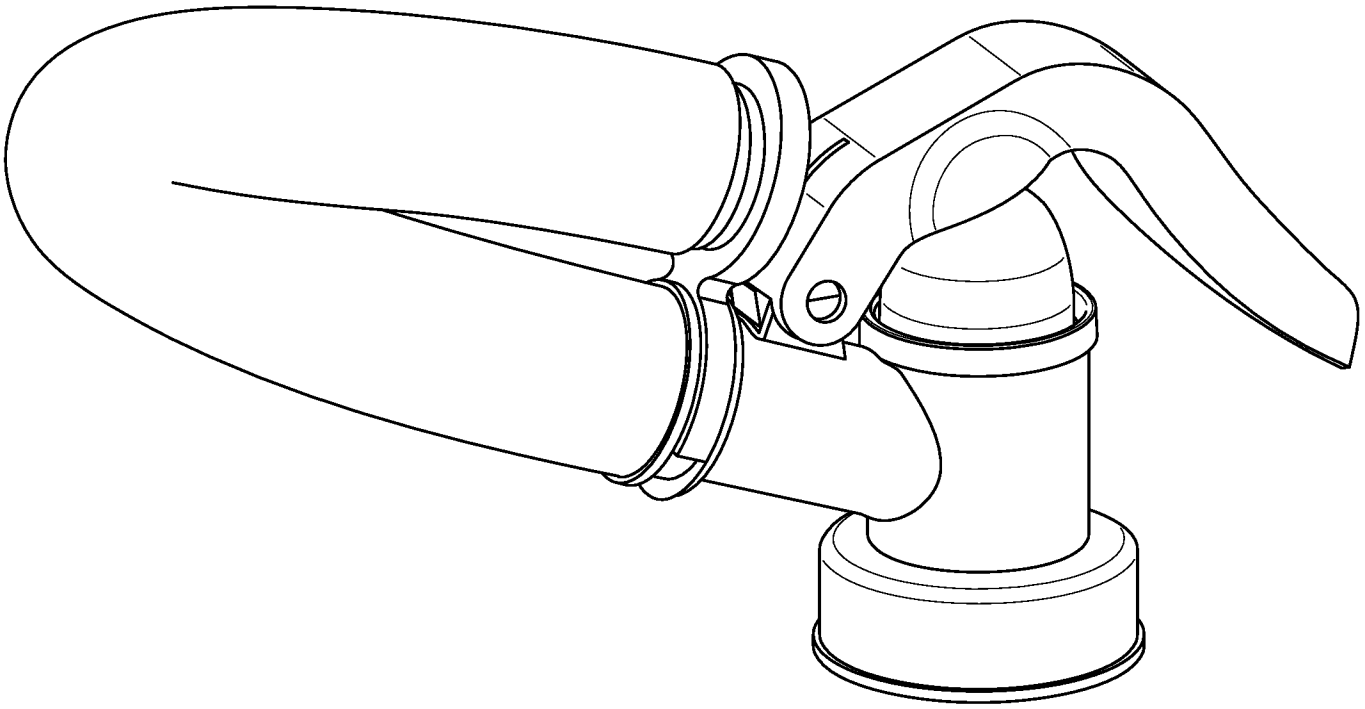
FIG. 11A and 11B shows another embodiment of the upright dispenser with both a lever arm and an extension tube, in the open and closed positions.
Figure 11B:
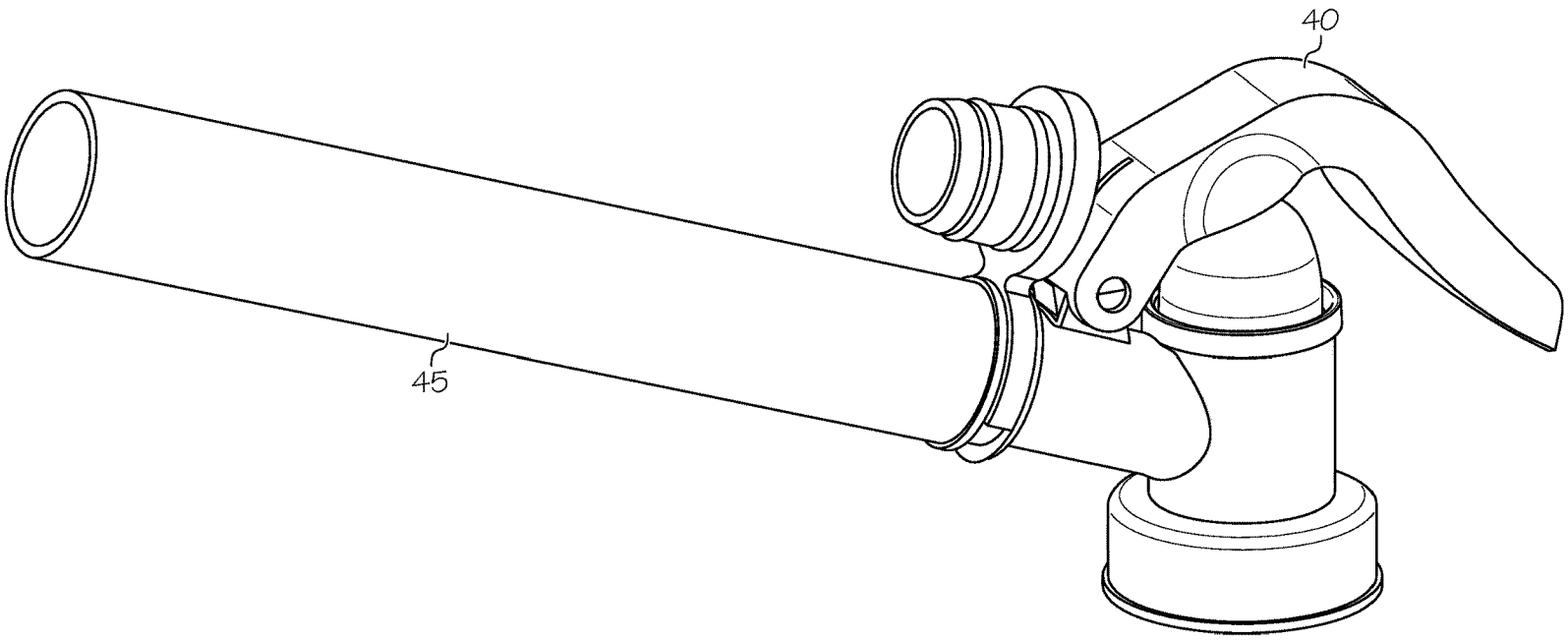

Referring now to FIG. 11A and 11B, another embodiment is shown in which both a lever arm 40 and an extension tube 45 are provided.

Figure 12:
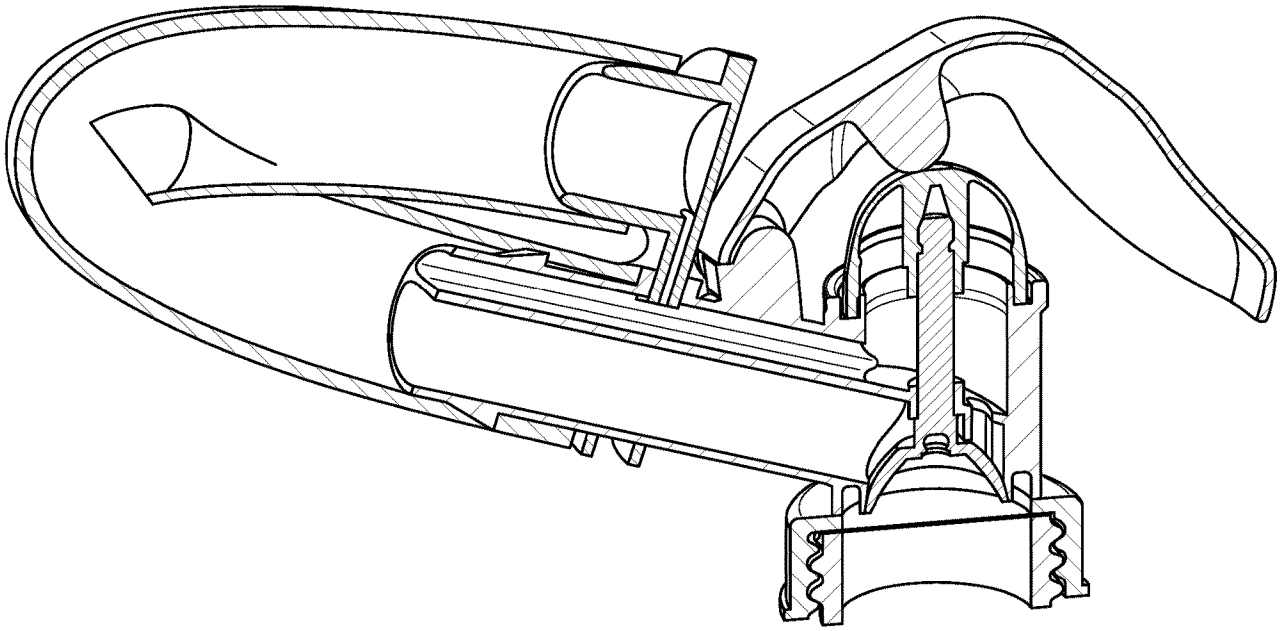
FIG. 12 is a view showing the closed position of FIG. 11.

Referring now to FIG. 12, the dispenser is shown in the normally closed position, with both the lever arm in the closed position (elastic button undepressed) and the extension tube bent and connected to the tube plug.

Figure 13:
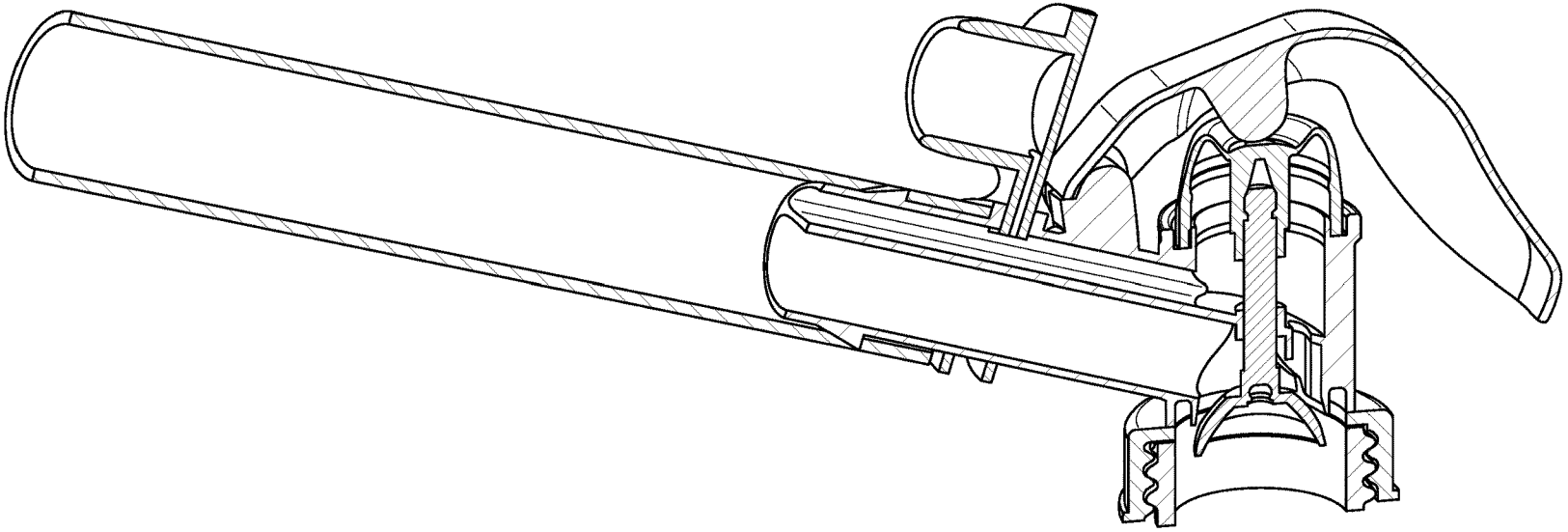
FIG. 13 is a cross section view of FIG. 12 showing the elastic button half depressed.

Referring now to FIG. 13, the dispenser of FIG. 12 is shown with the extension tube in the open position and the lever arm half depressing elastic button 26.

Figure 14:
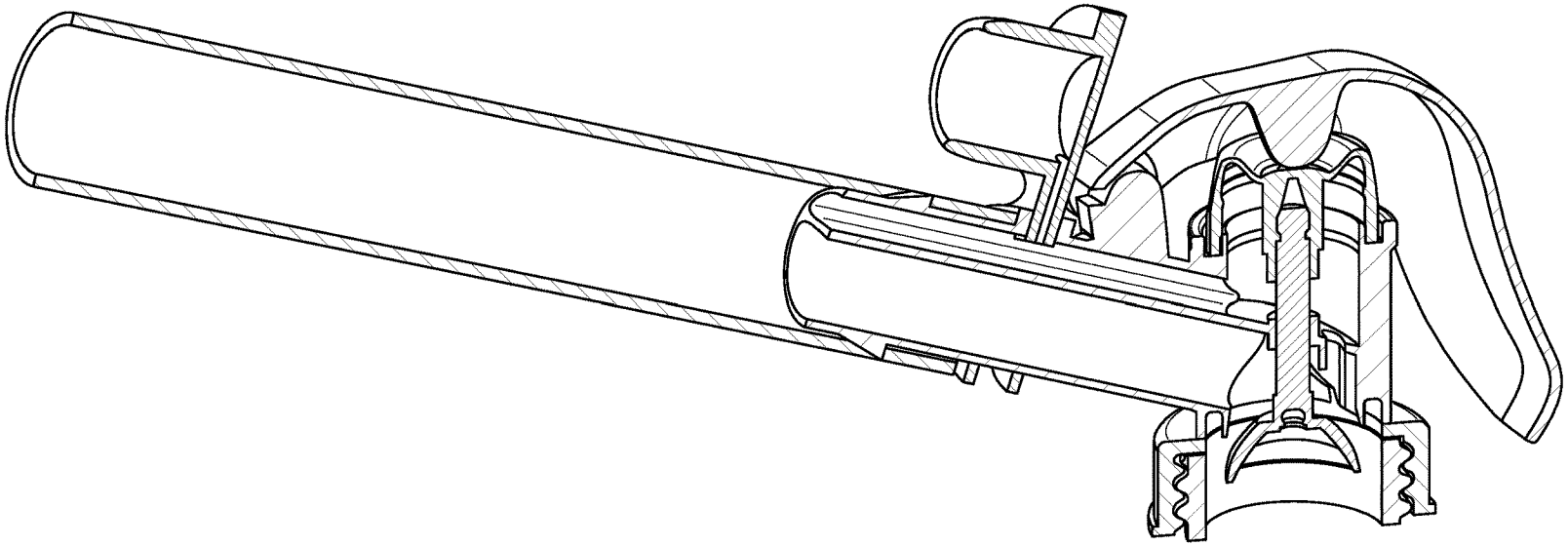
FIG. 14 is a cross section view of FIG. 12 showing the elastic button fully depressed.

Referring now to FIG. 14, the elastic button is shown in the fully depressed, open position.

Figure 15:
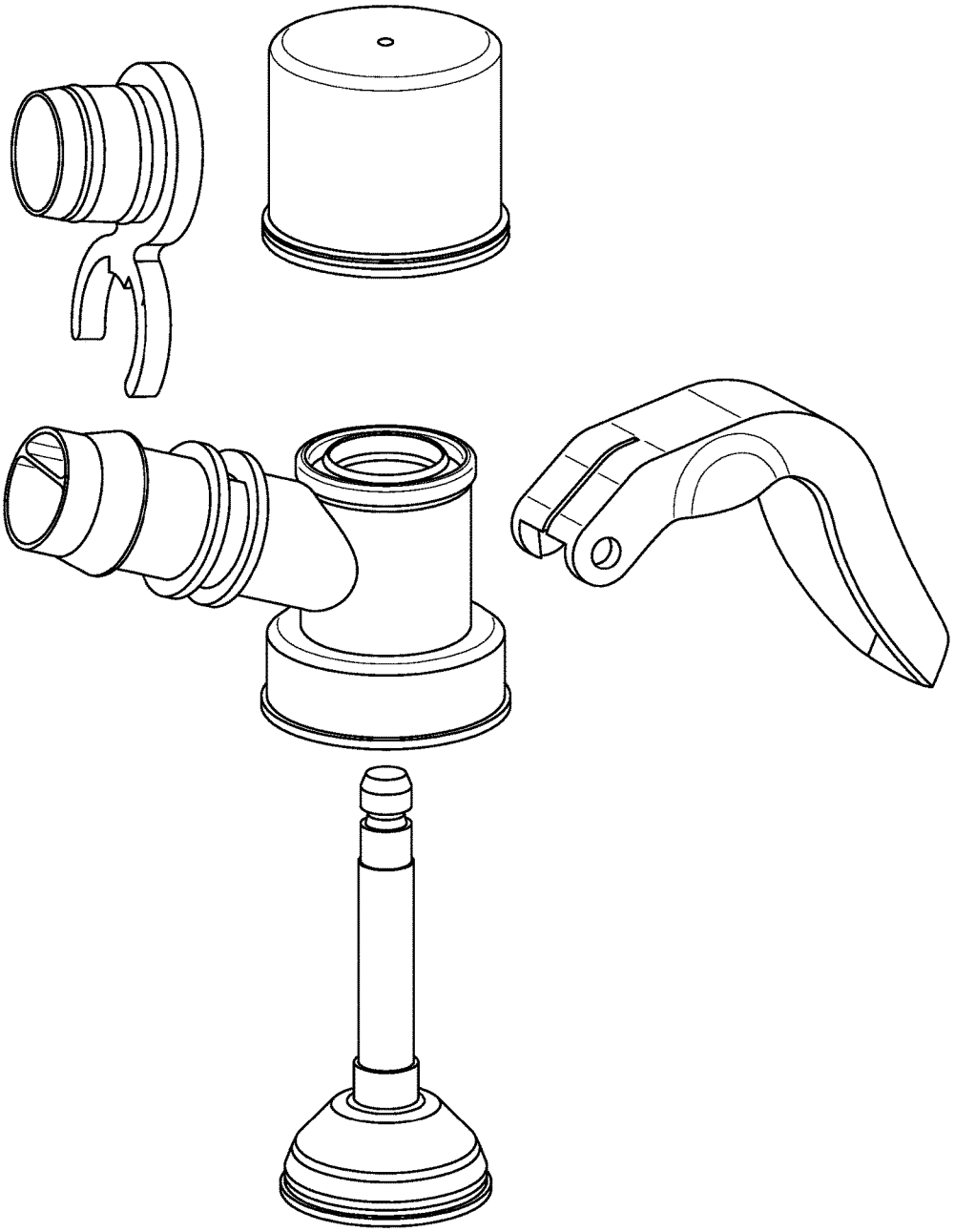
FIG. 15 shows an exploded view of the materials for some of the parts of the upright dispenser.
Figure 16:
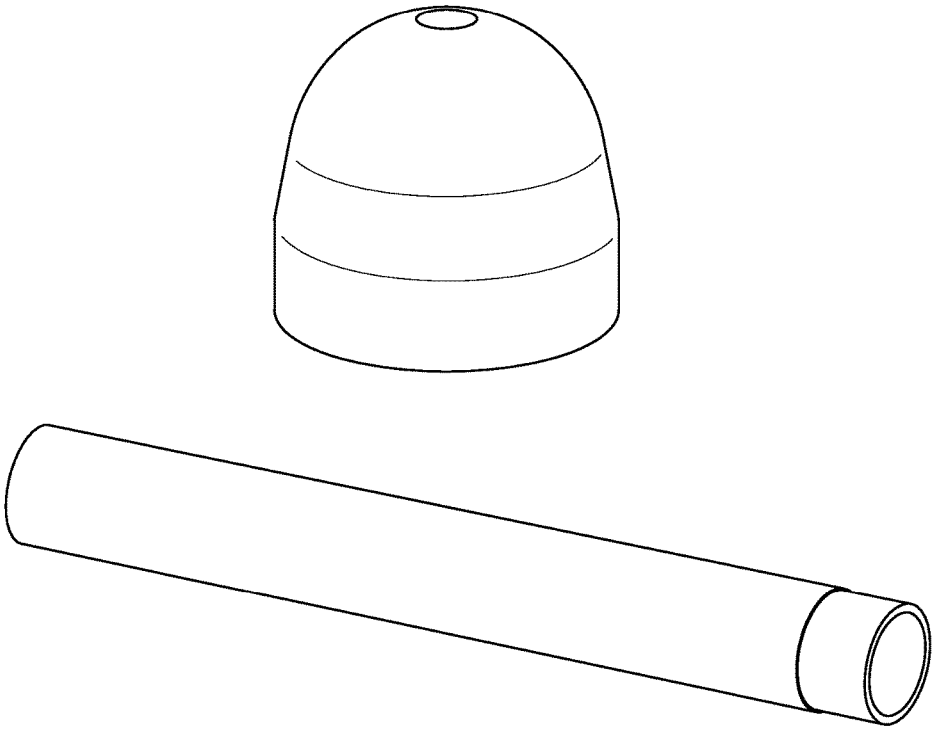
FIG. 16 shows the materials for the button and extension tube of the upright dispenser.

All of the parts of the invention are made out of various types of plastic. For example, FIG. 15 shows that the dispenser body, lever arm, valve, tamper cap and tube plug can be made out of polypropylene (PP), or high density polyethylene (HDPE). FIG. 16 shows that the elastic button(s) can be made from thermoplastic elastomer (TPE) or thermoplastic polyurethane (TPU), while the extension tube can be made of polypropylene (PP), high density polyethylene (HDPE), low density polyethylene (LDPE), thermoplastic elastomer (TPE), thermoplastic polyurethane (TPU), rubber, silicone and urethane.

What is claimed is:

1. An upright dispenser comprising:

an attachment end for attaching the dispenser to a container for holding material to be dispensed, the attachment end having a passageway which communicates with the container;

a dispensing tube, the dispensing tube having an upper through hole and a lower through hole which connect to the attachment end passageway, the upper through hole providing a vent and the lower through hole providing a path for the material to be dispensed;

the attachment end passageway having a sealing flange positioned below the upper through hole in the dispensing tube;

the attachment end having a top end with an elastic button, the elastic button being connected to a valve stem, the valve stem extending in the passageway and having a valve end which sealing engages with the sealing flange when the elastic button is in an undepressed position;

whereby when the elastic button is depressed, the valve end moves downwardly in the passageway to allow the material to flow out of the container and through the lower through hole of the dispensing tube, when the container and upright dispenser are tipped sufficiently to allow gravity to cause the material to flow between the valve end and the sealing flange and out through the lower through hole of the dispensing tube, the upper through hole providing venting to eliminate glugging, and when the elastic button is released, the elastic button elastically returns to an undepressed position, pulling the valve end into sealing engagement with the sealing flange.

2. The upright dispenser of claim 1 wherein the material to be dispensed is a liquid.

3. The upright dispenser of claim 1 wherein the container and the attachment end are threadably connected.

4. The upright dispenser of claim 1 wherein the material to be dispensed is selected from the group consisting of softener products, concentrated liquid products, chemical products, cleaners, oils, and personal care products.

5. The upright dispenser of claim 1 further including a tamper cap which snap fits to the upright dispenser, to cover the elastic button.

6. The upright dispenser of claim 1 further including a tamper foil seal which is removably connected to an end of the dispenser tube.

7. The upright dispenser of claim 1 further including a tamper foil seal which is removably connected below the valve end and the container.

8. The upright dispenser of claim 1 wherein the upper through hole is smaller than the lower through hole.

9. The upright dispenser of claim 1 wherein the upper through hole is 10 to 50% of the volume of the dispensing tube.

10. The upright dispenser of claim 1 further including a lever which is pivotably connected to the dispenser tube and which has a normally closed position and an open position, the open position being when the lever is moved to depress the elastic button and the normally closed position being when the elastic button is in the undepressed position.

11. The upright dispenser of claim 1 further including an extension tube which frictionally engages with the dispensing tube, the extension tube having a tube plug connected to the extension tube, and the extension tube being flexible, so that an end opposite the end which frictionally engages with the dispensing tube can be bent and connected to the tube plug for storage.

12. The upright dispenser of claim 1 wherein the attachment end, valve stem, and valve end are made from a material selected from the group consisting of polypropylene (PP), high density polyethylene (HDPE), low density polyethylene (LDPE), thermoplastic elastomer (TPE), thermoplastic polyurethane (TPU), rubber, silicone and urethane.

13. The upright dispenser of claim 1 wherein the elastic button is made from a material selected from the group consisting of thermoplastic elastomer (TPE) or thermoplastic polyurethane (TPU).

14. The upright dispenser of claim 11 wherein the extension tube is made from a material selected from the group consisting of polypropylene (PP), high density polyethylene (HDPE), low density polyethylene (LDPE), thermoplastic elastomer (TPE), thermoplastic polyurethane (TPU), rubber, silicone and urethane.

* * * * *